US006286419B1

(12) United States Patent
Wallace

(10) Patent No.: US 6,286,419 B1
(45) Date of Patent: Sep. 11, 2001

(54) APPARATUS FOR ROLLING COMPRESSIBLE SHEET MATERIAL

(75) Inventor: Jack Arthur Wallace, Nashport, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/386,627

(22) Filed: Aug. 31, 1999

(51) Int. Cl.[7] ..... B30B 3/04

(52) U.S. Cl. ..... 100/86; 53/118; 242/532; 242/541.2

(58) Field of Search ..... 100/76, 86; 242/532, 242/535.1, 541.2, 918; 53/116–118

(56) References Cited

U.S. PATENT DOCUMENTS

| | | | | |
|---|---|---|---|---|
| 603,784 | * | 5/1898 | Dyer | 100/86 |
| 811,614 | * | 2/1906 | Bernard | 100/86 |
| 1,193,506 | | 8/1916 | Brown . | |
| 3,250,484 | * | 5/1966 | Fair | 242/541.2 |
| 3,678,646 | | 7/1972 | Clark . | |
| 3,931,940 | * | 1/1976 | Raighn et al. | 242/541.2 |
| 3,991,538 | * | 11/1976 | Finn et al. | 53/118 X |
| 4,114,530 | | 9/1978 | Miller . | |
| 4,344,585 | * | 8/1982 | Eglinton | 242/541.2 |
| 4,602,471 | | 7/1986 | Gray et al. . | |
| 4,608,807 | | 9/1986 | Skripalle . | |
| 4,690,348 | * | 9/1987 | Watanabe et al. | 242/532 |
| 5,257,748 | | 11/1993 | Morizzo . | |
| 5,291,823 | * | 3/1994 | Kramps | 100/76 |
| 5,386,950 | * | 2/1995 | Abt | 242/532 |

* cited by examiner

*Primary Examiner*—Stephen F. Gerrity
(74) *Attorney, Agent, or Firm*—Inger H. Eckert; Stephen W. Barns

(57) ABSTRACT

A tucking bar for directing sheet material between a drive roller and a mandrel of a roll-up machine comprises an elongated member having opposing ends that are supported by an arm. The arm is adapted to pivot about an axis that is substantially parallel to an axis of rotation of the drive roller to move the elongated member along an arcuate path about the drive roller. A roll-up machine comprises a drive roller supported by a frame and a mandrel supported adjacent the drive roller. A tucking bar supported by a forward end of the frame is provided for tucking the sheet material between the drive roller and the mandrel. A method for rolling sheet material includes the steps of displacing the tucking bar to direct sheet material between a drive roller and a mandrel and rolling the sheet material on the mandrel.

22 Claims, 7 Drawing Sheets

APPARATUS FOR ROLLING COMPRESSIBLE SHEET MATERIAL

BACKGROUND OF THE INVENTION

This invention relates in general to an apparatus and a method for rolling compressible sheet material. More particularly, the invention relates to rolling fibrous sheets of insulation into a compressed roll. The method and apparatus are suitable for packing glass fiber insulation material.

Rolling sheets of insulation material into compressed rolls is well known. The prior art discloses or teaches machines for use in rolling sheet material. Such machines are commonly referred to as roll-up machines. Roll-up machines generally include a mandrel upon which the sheet material is rolled and one or more drive rollers for rolling the sheet material on the mandrel. To roll the sheet material on the mandrel, the sheet material is first fed between the drive rollers and the mandrel, then folded back around the mandrel, and subsequently tucked between the mandrel and the drive rollers. The sheet material is usually overlapped before it is tucked between the mandrel and the drive rollers to reduce the risk that the sheet material will wrinkle up at the core of the roll. This is commonly referred to as "crimping."

Currently, sheet material is manually tucked by machine operators who after tucking the sheet material must wrap the sheet material around the mandrel at least three times to sufficiently start the sheet material on the mandrel. Wide sheet materials are often difficult to tuck uniformly and wrap around the mandrel. If the machine operators are unable to tuck uniformly and start the sheet material, the sheet material may still wrinkle even if the sheet material is overlapped prior to being tucked and started. In an effort to solve this problem, a number of machine operators have been assigned the arduous task of manually tucking and starting the sheet material on the mandrel. However, this solution has not been entirely effective because the machine operators fail to tuck and start the sheet material uniformly relative to one another.

The sheet material not only has to be tucked uniformly and started, but constant uniform pressure must be applied on the sheet material as the sheet material is being rolled. This poses yet another problem. Conventional roll-up machines do not maintain a constant uniform pressure on the sheet material as the sheet material is being rolled on the mandrel. This results in an axial displacement of the core of the rolled sheet material relative to the outermost layers. The axial displacement of the core of the rolled sheet material is commonly referred to as "telescoping." A solution to this problem has yet to be presented.

In addition to being ineffective and labor intensive, manually tucking and starting sheet materials on the mandrel may pose risk of injury to the machine operators. This may be a safety concern to manufacturers and processors of sheet materials. A roll-up machine that will eliminate the need for manually tucking and starting sheet material on a mandrel is needed.

SUMMARY OF THE INVENTION

The present invention is directed towards a tucking bar for tucking sheet material between a drive roller and a mandrel of a roll-up machine. The tucking bar comprises an elongated member having opposing ends that are supported by an arm. The arm is adapted to pivot about an axis that is substantially parallel to an axis of rotation of the drive roller to move the elongated member along an arcuate path about the drive roller.

The invention is also directed towards a roll-up machine comprising a drive roller supported by a frame and a mandrel supported adjacent the drive roller. A tucking bar supported by a forward end of the frame is provided for tucking the sheet material between the drive roller and the mandrel.

The invention is further directed towards a method for rolling sheet material comprising the steps of displacing the tucking bar to direct the sheet material between the drive roller and the mandrel and rolling the sheet material on the mandrel.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
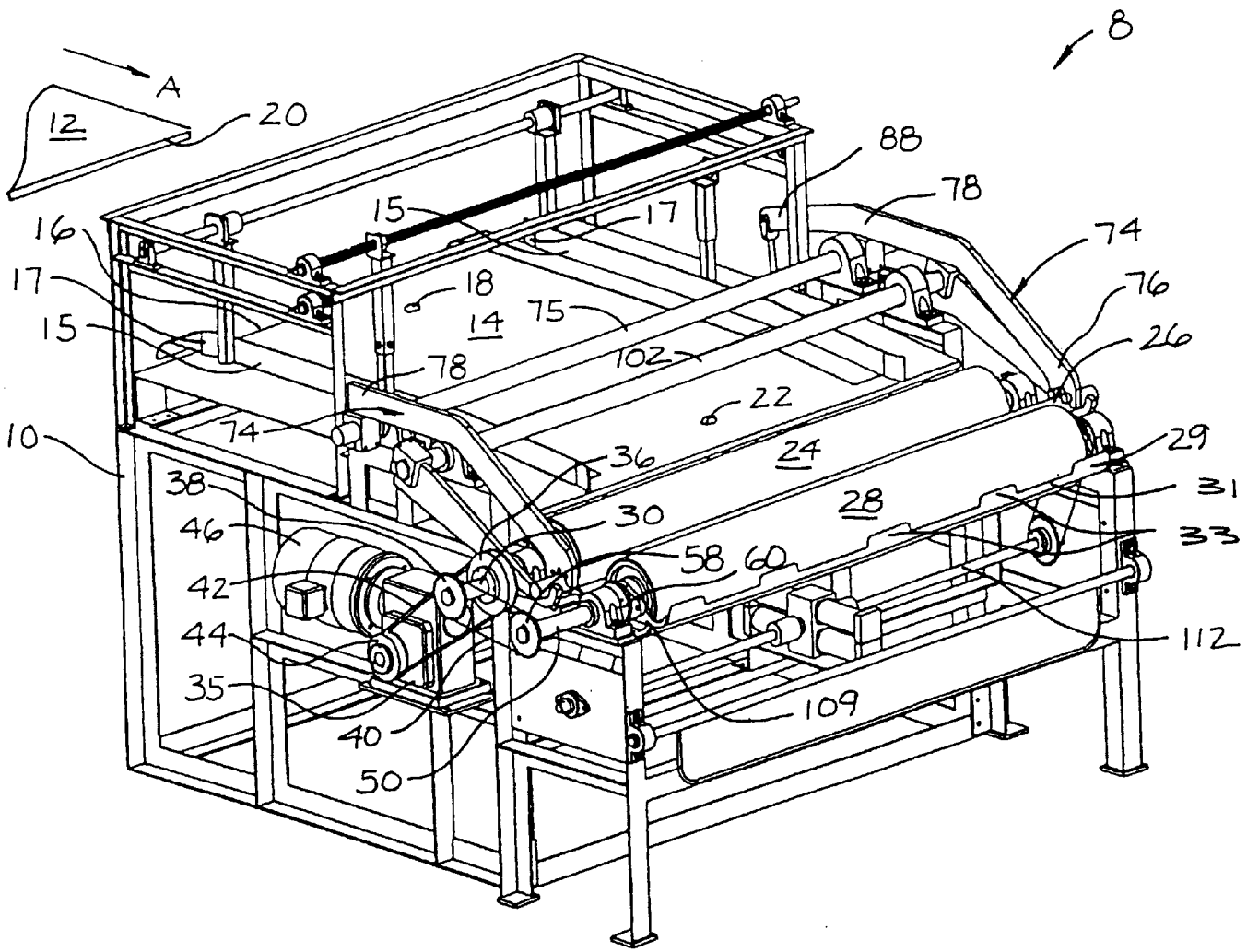
FIG. 1 is a front perspective view, taken from the right side, of a roll-up machine for rolling sheet material.

Referring now to the drawings, there is illustrated in FIGS. 1–4 a roll-up machine 8 for rolling sheet material 12 into a roll for packing. The roll-up machine 8 includes a frame 10. The frame 10 supports a conveyor surface, such as the perforated plate 14 shown, and side guides 15. The perforated plate 14 has a back edge 16 (shown in FIGS. 1 and 3) for receiving sheet material 12 that is to be rolled and subsequently packaged. A ramp is defined at the back edge 16 of the perforated plate 14 between opposing arcuate shaped portions 17 of the side guides 15. The arcuate shaped portions 17 form a funnel configuration that aids in guiding the sheet material 12 along the perforated plate 14. The sheet material 12 is guided onto the perforated plate 14 by a conveyor mechanism, such as an oven chain (not shown). An oven chain transports coated sheet material 12 through a curing oven (not shown) and further to the perforated plate 14. The roll-up machine 8 is preferably used for rolling sheet material 12 having a density in a range from about one to about six pounds per cubic foot (PCF). Hence, sheet material 12 on the oven chain pushes sheet material 12 along the perforated plate 14 in the direction of arrow A (shown in FIGS. 1, 3, and 5) from the back of the roll-up machine 8 to the front of the roll-up machine 8. Air released through perforations (not shown) in the perforated plate 14 lifts the sheet material 12 off the perforated plate 14 to reduce frictional contact between the sheet material 12 and perforated plate 14. This allows the oven chain to easily push the sheet material 12 along the perforated plate 14.

A first detector 18 (shown in FIGS. 1 and 3) is located proximate the back edge 16 of the perforated plate 14. The first detector 18 is provided for detecting the presence of the sheet material 12 as the sheet material 12 travels along the perforated plate 14. A photo-light would be a suitable first detector 18. A photo-light would be capable of simultaneously emitting light and detecting light reflected from the sheet material 12. An initial detection of light reflected from the sheet material 12 would correspond to the detection of the leading edge 20 of the sheet material 12. The absence of light reflected from the sheet material 12 would correspond to the detection of a trailing edge 21 (shown in FIG. 3) of the sheet material 12. The detection of the leading edge 20 and the trailing edge 21 of the sheet material 12 is critical to the operation of the roll-up machine 8, as will be appreciated upon reading the description below. Although a photo-light is a preferred detection device, other detection devices may be suitable for carrying out the invention.

A second detector 22, as shown in FIG. 1, is spaced apart or located a predetermined distance forward from the first detector 18. The second detector 22 may likewise be a photo-light. The second detector 22 is provided for detecting the presence of the sheet material 12 and, most particularly, for detecting the leading edge 20 of the sheet material 12. A time interval may be measured from a point in time when the first detector 18 detects the leading edge 20 of the sheet material 12 to a point in time when the second detector 22 detects the leading edge 20 of the sheet material 12. The distance between the two detectors 18, 22 is a predetermined distance. The time interval between the two points in time and the predetermined distance is used to calculate a rate of travel of the sheet material 12. The rate of travel can be calculated with substantial accuracy. The rate of travel is an important factor throughout the operation of the roll-up machine 8, as will become apparent in the description below.

A forward end of the frame 10 supports one or more drive rollers (such as the back roller 24 and front roller 28 shown), a mandrel 26, a guide roll 27, and a tucking bar 29. The back roller 24, the mandrel 26, and the front roller 28 are all located forward from the perforated plate 14 and preferably forward of the second detector 22. It should be noted that the elevation of the perforated plate 14 may be slightly greater than that of the back roller 24 and that the elevation of back roller 24 may be slightly greater than that of the front roller 28. This creates an angle of decline from the perforated plate 14 to the front roller 28. An angle of decline in a range from about 15 degrees to about 30 degrees may be beneficial when rolling high-density sheet material, such as AEROFLEX® insulation, an insulation product manufactured by Owens Corning of Toledo, Ohio.

The back roller 24 is supported by the frame 10 via a back roller shaft 30. The back roller shaft 30 has opposing ends that are supported by bearings 32 (shown in FIGS. 3 and 4) that are mounted in pillar blocks 34 (also shown in FIGS. 3 and 4) located at opposing sides of the frame 10. At least one end of the back roller shaft 30 supports a driven pulley 36 and a first drive sprocket 38, as shown in FIG. 1. The first drive sprocket 38 supports a chain 40 that, in turn, drives the front roller 28, as will be discussed below. The driven pulley 36 is connected to a drive pulley 44 by a timing belt 42. The drive pulley 44 is driven by a motive force, such as the motor drive unit 46 shown. The motor drive unit 30 is preferably a variable speed motor controlled by a controller 48 (shown in FIG. 7). A gearbox 35 may be connected to the motor drive unit 30 for varying the speed and torque produced by the motor drive unit 30.

The front roller 28 is supported by the frame 10 via a front roller shaft 50. The front roller shaft 50 has opposing ends that are supported by bearings 52 (shown in FIGS. 3 and 4) that are mounted in pillar blocks 54 (also shown in FIGS. 3 and 4) located at opposing sides of the frame 10 forward of the back roller pillar blocks 34. An end of the front roller shaft 50 supports a pair of driven sprockets 58, 60. As shown in FIG. 1, a first driven sprocket 58 is connected to the first drive sprocket 38 for rotating the front roller shaft 50, which in turn drives the front roller 28. A second driven sprocket 60 carries a chain 62 (shown in FIG. 3) that actuates the tucking bar 29, as will become apparent in the description below. The second driven sprocket 60 is supported on the front roller shaft 50 by a flange bearing which permits the second driven sprocket 60 to spin freely on the front roller shaft 50 until the controller 48 (shown in FIG. 7) signals the tucking bar 29 to tuck the sheet material 12, as will be more greatly appreciated in the description of the operation of the roll-up machine 8 hereinbelow.

Figure 2:
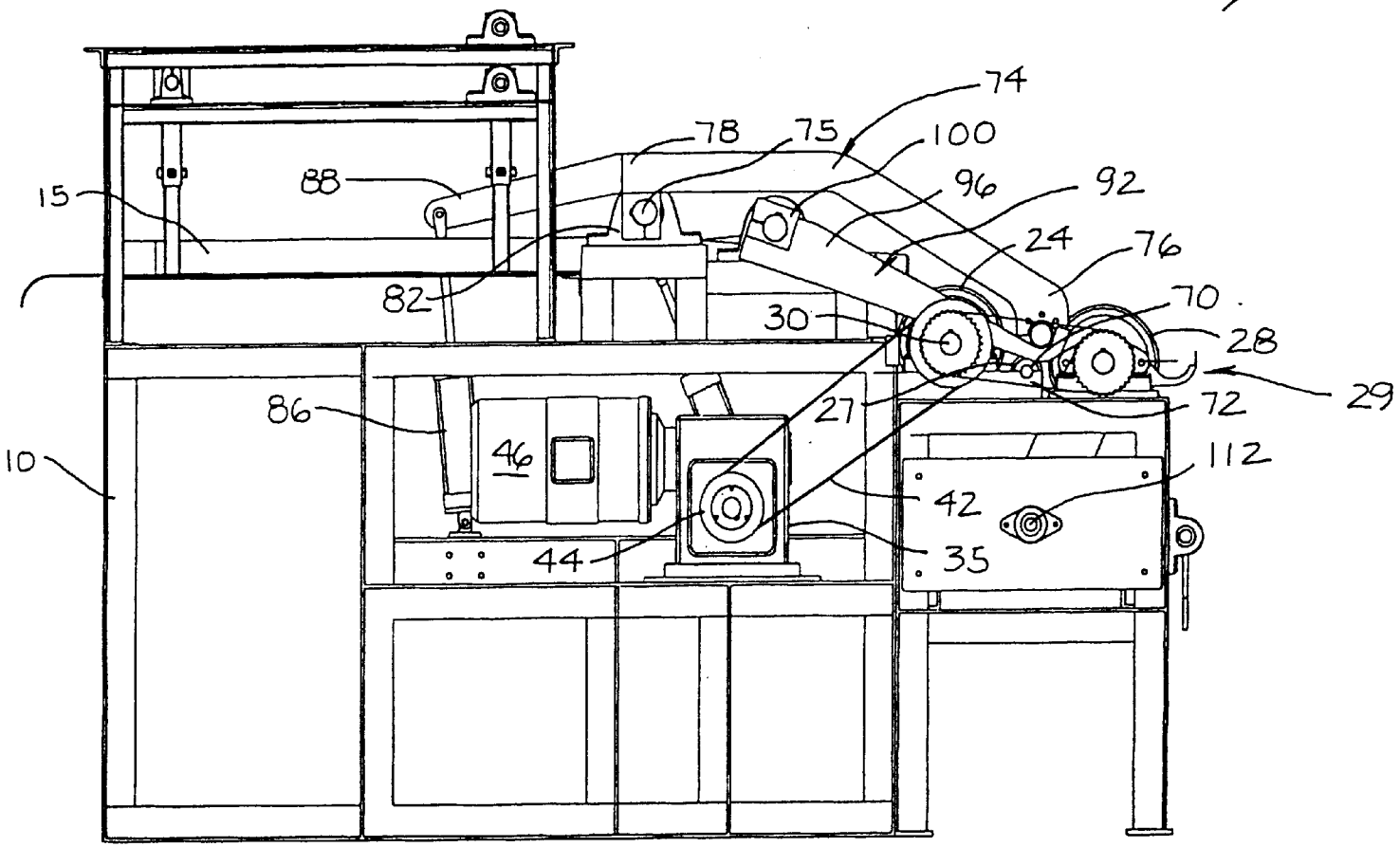
FIG. 2 is a right side elevational view of the roll-up machine.
Figure 4:
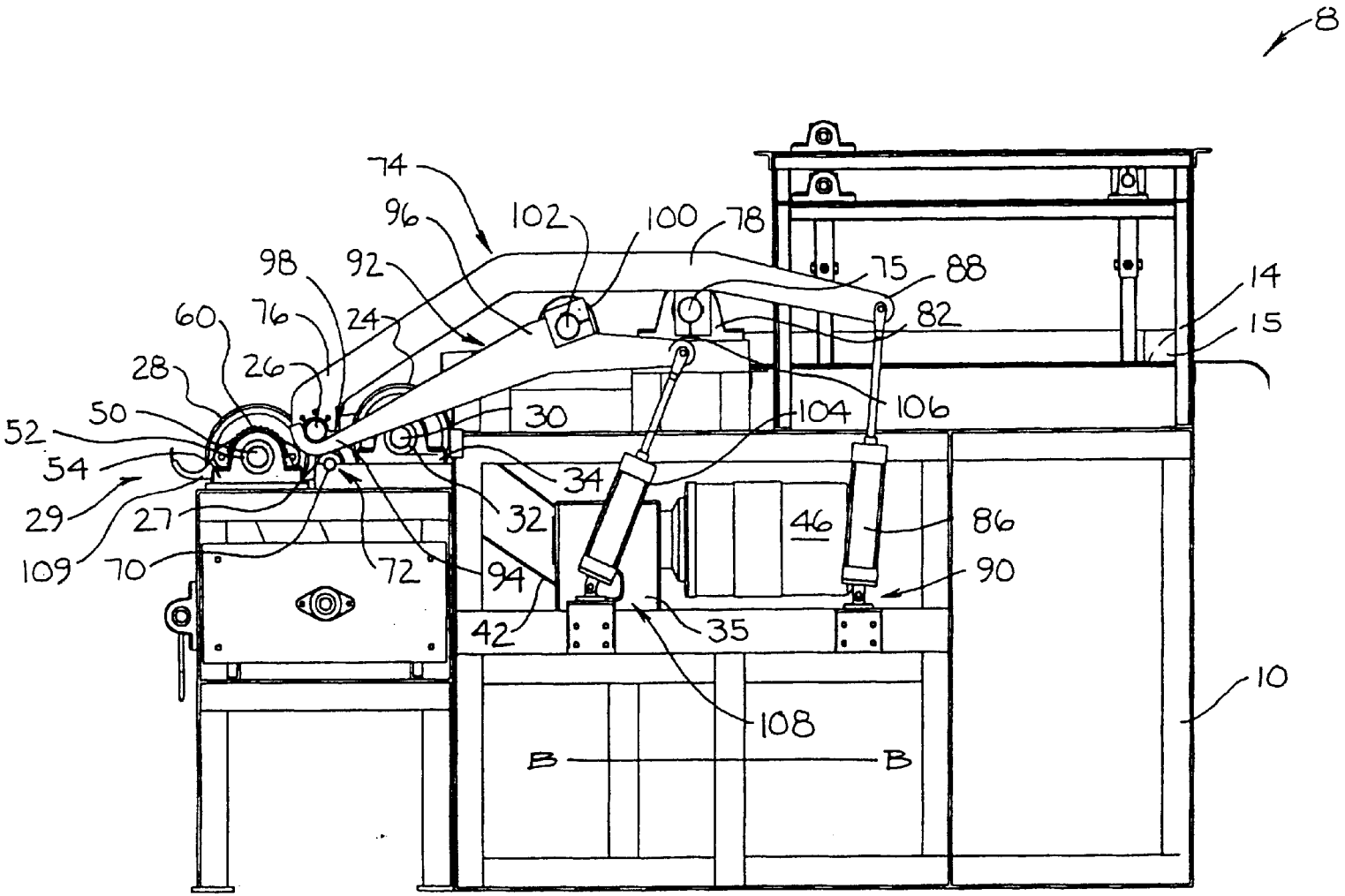
FIG. 4 is a left side elevational view of the roll-up machine.

As shown in FIGS. 2 and 4, the guide roll 27 is located between the back roller 24 and the front roller 28. The guide roll axis 64 (shown in FIG. 5) is substantially parallel to the back roller axis 66 and front roller axis 68 (also shown in FIG. 5). Each opposing end of the guide roll 27 includes a reduced diameter portion 70. Each reduced diameter portion 70 is rotatably supported in a corresponding cradle 72 connected to the opposing sides of the frame 10. The guide roll 27 is located in close proximity to the front roller 28. The guide roll 27 is provided for preventing a loss of compression when the sheet material 12 is initially tucked. That is to say, the guide roll 27 keeps the sheet material 12 tight on the mandrel 26 as the sheet material 12 is tucked and started on the mandrel 26. It may also be desirable that the front roller 28 be driven slightly faster than the back roller 24, such as five percent faster, to further ensure that the sheet material 12 remains tight on the mandrel 26.

Figure 3:
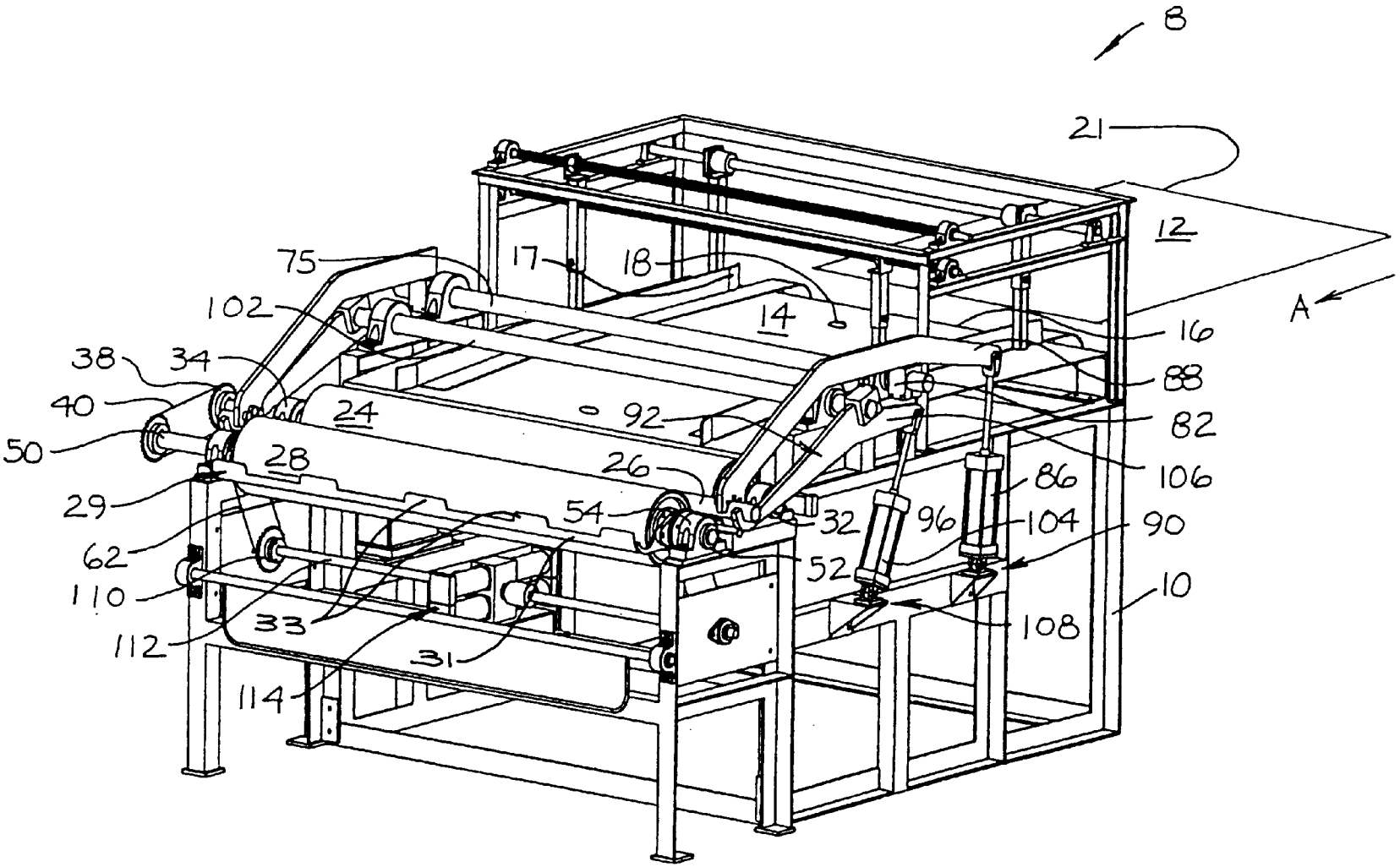
FIG. 3 is a front perspective view, taken from the left side, of the roll-up machine.

The mandrel 26 is displaceable to be removably inserted between and adjacent to the back roller 24 and the front roller 28 and above the guide roll 27. The mandrel 26 is displaceable via a pair of roll winding pressure arms 74. Each pressure arm 74 has a front end 76 and a back end 78. The front end 76 of each pressure arm 74 supports a corresponding end of the mandrel 26. Roller bearings (not shown) may be interposed between the front end 76 of the pressure arm 74 and the mandrel 26 to reduce the frictional contact therebetween. The back end 78 of each pressure arm 74 is pivotally supported by opposing sides of an upper medial portion of the frame 10. As illustrated in FIG. 3, each side of an upper medial portion of the frame 10 supports a pillar block 82. Each pillar block 82 is provided for receiving a bearing (not shown) which supports a corresponding end of a pressure arm shaft 75. Each end of the pressure arm shaft 75 is keyed (not shown) to matingly engage a corresponding one of the pressure arms 74, the purpose of which will be more greatly appreciated in the description that follows.

At least one of the pressure arms 74 is pivotally connected to a first, pressure arm air cylinder 86. As illustrated in FIG. 2, one of the pressure arms 74 has a lever 88 extending from the back end 78 thereof. An upper end of the pressure arm air cylinder 86 is pivotally connected to a back end of the lever 88. A lower end of the pressure arm air cylinder 86 is connected to a pivot block 90. The pivot block 90 is supported by a lower medial portion of the frame 10. It is preferred that the pivot block 90 include a swivel head (not shown) that permits the lower end of the pressure arm air cylinder 86 to move longitudinally to prevent binding during the operation of the roll-up machine 8. When the pressure arm air cylinder piston is extended, the lever 88 is raised and the front end 76 of the pressure arm 74 is lowered to lower the mandrel 26. When the pressure arm air cylinder piston is retracted, the lever 88 is lowered and the front end 76 of the pressure arm 74 is raised to raise the mandrel 26. Since the pressure arm shaft 75 is keyed to matingly engage each pressure arm 74, a single pressure arm air cylinder 86 connected to one pressure arm 74 may control the movement of both pressure arms 74. The pressure arm air cylinder 86 is controlled by the controller 48 (shown in FIG. 7) to raise and lower the mandrel 26 and to maintain a desired amount of uniform pressure between the mandrel 26 and the sheet material 12 being rolled on the mandrel 26. A desired amount of uniform pressure may be arrived at through the aid of regulators and control valves (not shown) that are operated by the controller 48 to control the tightness of the sheet material 12 being rolled on the mandrel 26.

The mandrel 26 is displaceable in an upward direction against the force exerted by the pressure arms 74 by a pair of cradle arms 92 to enable the sheet material 12 to pass between the mandrel 26 and the front and back rollers 28, 24. As shown in FIG. 4, each cradle arm 92 has a front end 94 (shown in FIG. 4) and a back end 96. The front end 94 of each cradle arm 92 includes a cradle 98 (shown in FIG. 4) that supports a corresponding end of the mandrel 26. The back end 96 of each cradle arm 92 is pivotally supported by opposing sides of an upper medial portion of the frame 10. Each side of an upper medial portion of the frame 10 supports a pillar block 100. Each pillar block 100 is provided for receiving a bearing (not shown) for supporting a corresponding end of a cradle arm shaft 102. Each end of the cradle arm shaft 102 is keyed (not shown) to matingly engage a corresponding one of the cradle arms 92, similar to that of the pressure arm shaft 75 described above.

At least one of the cradle arms 92 is pivotally connected to a second, cradle arm air cylinder 104. This may be accomplished as follows. One of the cradle arms 92 may have a cradle arm lever 106 that extends from the back end 96 thereof. An upper end of the cradle arm air cylinder 104 may be pivotally connected to a back end of the cradle arm lever 106. A lower end of the cradle arm air cylinder 104 may be connected to a pivot block 108. The pivot block 108 is supported by a lower medial portion of the frame 10. It is preferred that the pivot block 108 include a swivel head (not shown) that permits the lower end of the cradle arm air cylinder 104 to move longitudinally along the line B—B (shown in FIG. 4) to prevent binding during the operation of the roll-up machine 8. When the cradle arm air cylinder piston is retracted, the cradle arm lever 106 is lowered and the front end 94 of the cradle arm 92 is raised to raise the mandrel 26 against the force of the pressure arm 74. This position may be referred to as the "feed position" because the sheet material 12 may be fed under the mandrel 26. When the cradle arm air cylinder piston is extended, the cradle arm lever 106 is raised and the front end 94 of the cradle arm 92 is lowered to lower the mandrel 26. This position may be referred to as the "tuck position" because, in this position, the sheet material 12 may be tucked between the back roller 24 and the mandrel 26. Since the cradle arm shaft 102 is keyed to matingly engage each cradle arm 92, a single cradle arm air cylinder 104 connected to one cradle arm 92 may control the movement of both cradle arms 92. In a manner similar to the operation of the first air cylinder 86 above, the cradle arm air cylinder 104 is controlled by the controller 48 (shown in FIG. 7) to raise and lower the mandrel 26 throughout the operation of the roll-up machine 8.

As shown in FIGS. 1 and 3, the tucking bar 29 includes a laterally extending elongated member 31 having opposing ends. Each opposing end is supported by an arm 109 that is pivotal about an axis that is substantially parallel to the axis of rotation of the front roller 28 so that the elongated member 31 can move along an arcuate path about the front roller 28. This can be accomplished by coupling the arm 109 to the second driven sprocket 60. As stated above, the second driven sprocket 60 is supported on the front roller 28 by a flange bearing which permits the second driven sprocket 60 to spin freely on the front roller shaft 50 until the controller 48 (shown in FIG. 7) signals the tucking bar 29 to tuck the sheet material 12 on the mandrel 26. A chain 62 connects the second driven sprocket 60 to a second drive sprocket 110 (shown in FIG. 3) supported by an actuating rod 112, as shown in FIG. 3. The actuating rod 112 is rotatably supported by a pair of plates (shown but not referenced) connected to opposing sides of the front end of the frame 10. The actuating rod 112 is driven by a rack and gear arrangement (not shown). The rack and gear arrangement is operated by an air cylinder, generally indicated at 114. The air cylinder 114 is controlled by the controller 48. The controller 48 causes the air cylinder 114 to displace a rack (not shown). The rack causes a gear (also not shown) supported by the actuating rod 112 to turn. The gear turns the actuating rod 112, which, in turn, turns the second drive sprocket 110. The second drive sprocket 110 drives the second driven sprocket 60 via the chain 62. This causes the tucking bar 29 to move along an arcuate path about the front roller 28. As the tucking bar 29 moves along the arcuate path, it folds the sheet material 12 over the mandrel 26 and tucks or directs the sheet material 12 between the back roller 24 and the mandrel 26. The sheet material 12 is then fed between the guide roll 27 and the mandrel 26 and further between the front roller 28 and the mandrel 26. As the rollers 24, 28 continue to rotate, the sheet material 12 continues to roll up onto the mandrel 26 and the guide roll 27 keeps the sheet material 12 tight so that the sheet material 12 does not wrinkle.

It should be understood that an additional second driven sprocket 60 could be located at an opposing end of the front roller 28. Each arm 109 of the tucking bar 29 can be connected to a corresponding one of the second driven sprockets 60. A chain 62 can connect each second driven sprocket 60 to a corresponding second drive sprocket 110. The second drive sprockets 110 can be supported by opposing ends of the actuating rod 112. The actuating rod 112 can be driven by a rack and gear arrangement (not shown) that is operated by a double-stack air cylinder 114. The double-stack air cylinder 114 can be controlled by the controller 48 to cause the air cylinder 114 to displace the rack and cause the gear supported by the actuating rod 112 to turn. The gear turns the actuating rod 112, which, in turn, turns each second drive sprocket 110. The second drive sprockets 110 drive the second driven sprockets 60 via the chains 62 to turn each arm 109 of the tucking bar 29.

It should be noted that the tucking bar 29 may be provided with a plurality of laterally spaced fingers 33. The fingers 33 may reduce the risk that the tucking bar 29 will get caught in the sheet material 12 which would make the tucking bar 29 difficult to retract after tucking the sheet material 12.

Figure 5:
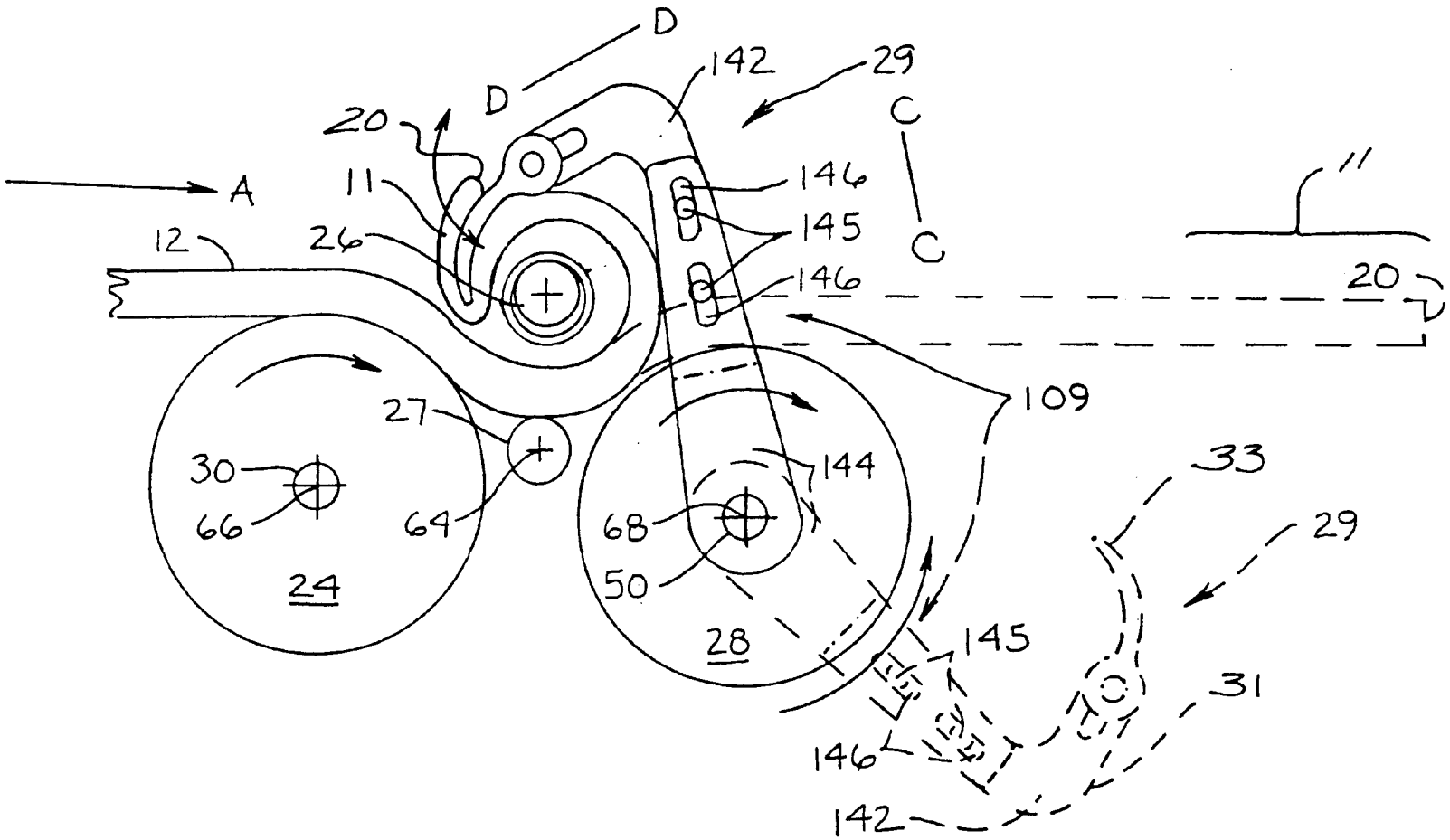
FIG. 5 is an enlarged environmental side elevational view of a tucking bar for tucking sheet material between a drive roller and a mandrel of the roll-up machine.

The tucking bar 29 may be adjusted for tucking sheet materials of different thicknesses and densities. As shown in FIG. 5, the tucking bar 29 may include a pair of opposing arms 109. Each arm 109 may be generally L-shaped in construction. The arms 109 may be formed from a plurality of parts 142, 144 wherein at least one part 142 is movable relative to another part 144. For example, there is illustrated a first part 142 that is linearly adjustable relative to a second part 144. This may be accomplished by providing at least one elongated slot 146 in one of the parts 142, 144 of the arm 109. As shown in the drawings, the slot 146 may extend radially relative to the pivotal axis of the arm 109. A fastener 145 may be employed to releasably connect the two parts 142, 144 of the arm 109 together. By tightening the fastener, the two parts may be tightly coupled together. Upon loosening the fastener 145, the first part 142 may be displaced relative to the second part 144. This permits the arm 109 to be linearly extensible, or adjusted in a direction along the line C—C.

In addition, the elongated member 31 may be pivotally adjustable relative to the arms 109, as shown in FIG. 5. This may be accomplished by merely pivoting the tucking bar 29 relative to the arms 109. In addition to being pivotally adjustable, the tucking bar 29 may be adjustable in a direction D—D transverse to the arm 109.

The foregoing adjustments permit the amount of rotation of the tucking bar 29 and the angular disposition of the tucking bar 29 to be varied.

Figure 6:
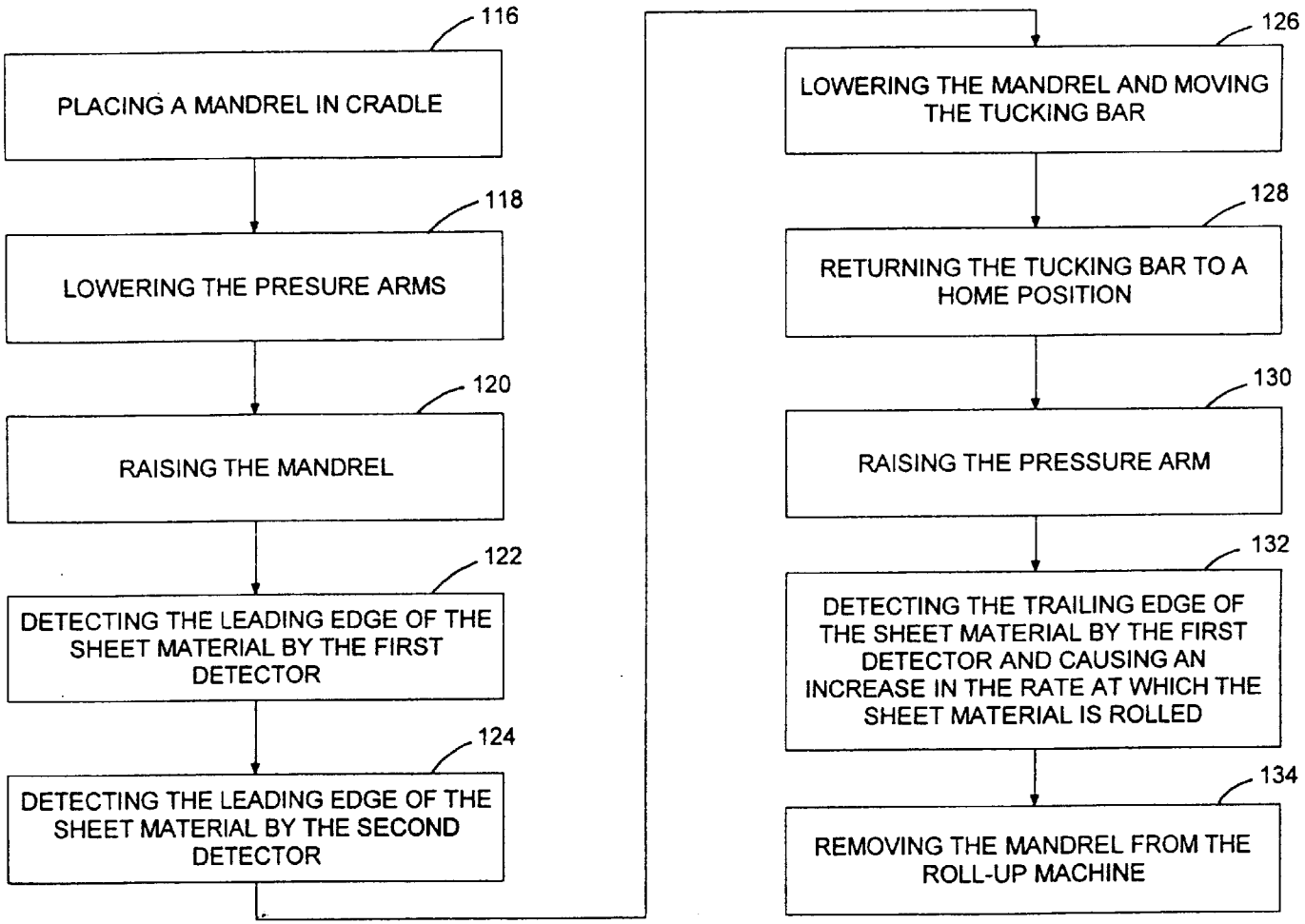
FIG. 6 is a flow chart of a method for rolling sheet material.

The operation of the roll-up machine 8 is best understood with reference to FIG. 6. The operation of the roll-up machine 8 begins by placing a mandrel 26 in the cradle 98, as indicated in function block 116. The mandrel 26 may be placed in the cradle 98 manually by a machine operator or automatically by an automated device (not shown). After placing the mandrel 26 in the cradle 98, the pressure arms 74 are lowered, as indicated in function block 118, against opposing ends of the mandrel 26. Movement of the pressure arms 74 is accomplished by the first air cylinder 86. The first air cylinder 86 may be controlled by a switch (not shown) that is operated manually by the machine operator or automatically via an automated device (also not shown).

After lowering the pressure arms 74 against the mandrel 26, the cradle arms 92 are operated to raise the mandrel 26 against the force of the pressure arm 74, as indicated in function block 120. The cradle arms 92 exert an upward force on the opposing ends of the mandrel 26 that is greater than the downward force exerted by the pressure arms 74. Movement of the cradle arms 92 is accomplished by the second air cylinder 104. In a manner similar to the operation of the first air cylinder 86 set forth above, the second air cylinder 104 may be controlled by a switch (not shown) that is operated manually by a machine operator or automatically via an automated device (also not shown). The mandrel 26 is raised to an elevation that is a predetermined distance above that of the back and front rollers 24, 28. As the mandrel 26 is raised, the first and second detectors 18, 22 are energized.

Sheet material 12 is transported from a conveyor 16 that terminates at the back end of the roll-up machine 8 between the side guides 15 and onto the back end of the perforated plate 14. The arcuate shaped portions 17 of the side guides 15 guide the sheet material 12 along the perforated plate 14 between the side guides 15. The side guides 15 are preferably adjustable to accommodate sheet materials of various widths. The adjustments of the side guides 15 may be accomplished in any suitable manner.

Air is supplied through perforations (not shown) in the perforated plate 14 via an air supply. Air may be directed through the perforations in any suitable manner. The air forces the sheet material 12 upward to reduce frictional contact between the sheet material 12 and the perforated plate 14.

As the sheet material 12 progresses along the perforated plate 14, the leading edge 20 of the sheet material 12 is first detected by the first detector 18, as indicated in function block 122. The second detector 22 subsequently detects the leading edge 20 of the sheet material 12 when the leading edge 20 of the sheet material 12 reaches the second detector 22, as indicated in function block 124. A measure of time begins when the first detector 18 detects the leading edge 20 of the sheet material 12. The measure of time ends when the second detector 22 detects the leading edge 20 of the sheet material 12. This measure of time or time lapse is used to determine the rate of travel of the sheet material 12 through the roll-up machine 8. As stated above, the first detector 18 is located near the back end of the perforated plate 14. The second detector 22 is located near the front end of the perforated plate 14 or adjacent the back roller 24 or mandrel 26. The distance between the first and second detectors 18, 22 is known. Since the distance between the first and second detectors 18, 22 is known and since the measure of time for the sheet material 12 to travel the distance between the first and second detectors 18, 22 is known, the rate of travel of the sheet material 12 may be easily determined. Knowing the rate of travel of the sheet material 12 through the roll-up machine 8 is used to achieve a desired amount of overlap, as will be discussed in the description that follows.

As the sheet material 12 continues through the roll-up machine 8, the sheet material 12 approaches and passes over the back and front rollers 24, 28 and under the mandrel 26, and preferably further over the tucking bar 29. The tucking bar is in a "home position," as shown in phantom line in FIG. 5. The amount of sheet material 12 that passes over and beyond the tucking bar 29 is referred to as overlap 11 (shown in FIG. 5). A desired amount of overlap is necessary to reduce the risk that the leading edge 20 of sheet material 12 will crimp when the sheet material 12 is rolled up. A desired amount of overlap may easily be achieved in terms of a measure of time following the detection of the leading edge 20 of the sheet material 12 by either of the detectors 18, 22.

Once a measure of time corresponding to a desired amount of overlap has lapsed, the mandrel 26 is lowered adjacent to the front roller 28 while the tucking bar 29 simultaneously moves upward and rearward in an arcuate direction, as indicated in function block 126. The tucking bar 29 moves about the front roller 28 and over the mandrel 26 to tuck or direct the overlap material 32 between the back roller 24 and the mandrel 26 and further between the mandrel 26 and the guide roll 27. The front roller 28 pulls the sheet material 12 from between the mandrel 26 and the guide roll 27 over and about the mandrel 26. As stated above, the guide roll 27 ensures that the sheet material 12 remains tight on the mandrel 26. Once the sheet material 12 is tucked between the mandrel 26 and the guide roll 27 and started on the mandrel 26, the tucking bar 29 returns back to an initial or "home" position, as indicated in function block 128, where it remains out of the way from the remaining operation of the roll-up machine.

As the sheet material 12 is rolled onto the mandrel 26, the pressure arm 74 raises upward, as indicated in function block 130. The upward movement of the pressure arm 74 compensates for the increasing size of the sheet material 12 rolled about the mandrel 26. At the same time, the pressure arm 74 maintains a desired amount of pressure against the mandrel 26 to ensure that the sheet material 12 is rolled tightly against the mandrel 26.

When the trailing edge 21 of the sheet material 12 reaches the first detector 18, the first detector 18 may detect the presence of the trailing edge 21 of the sheet material 12 and produce a signal corresponding to the detection of trailing edge 21, as indicated in optional function block 132. The presence of this signal causes the operating speed of the motor drive unit 46 to increase to increase the rate in which the end of the sheet material 12 is rolled about the mandrel 26. Since the use of the roll-up machine 8 is contemplated for rolling subsequent sheets of material, the increased rate in which the end of the sheet material 12 is rolled about the mandrel 26 provides additional time before rolling successive sheet material. This additional time may be used to bind the roll of sheet material 12 and remove the mandrel 26 together with the bound roll of sheet material 12 from the roll-up machine 8, as indicated in function block 134. The bound roll of sheet material 12 is then removed from the mandrel 26. To assist the operator in expediently removing the rolled sheet material 12 from the mandrel 26, the sheet material 12 may be rolled up on a tube, such as a cardboard tube (not shown). The tube would preferably fit loosely on the mandrel 26. The tube together with the sheet material 12 rolled thereon may easily be removed from the mandrel 26. After removing the sheet material 12, the mandrel 26 is again placed back in the cradle 98, as indicated in function block 116 as set forth above.

Figure 7:
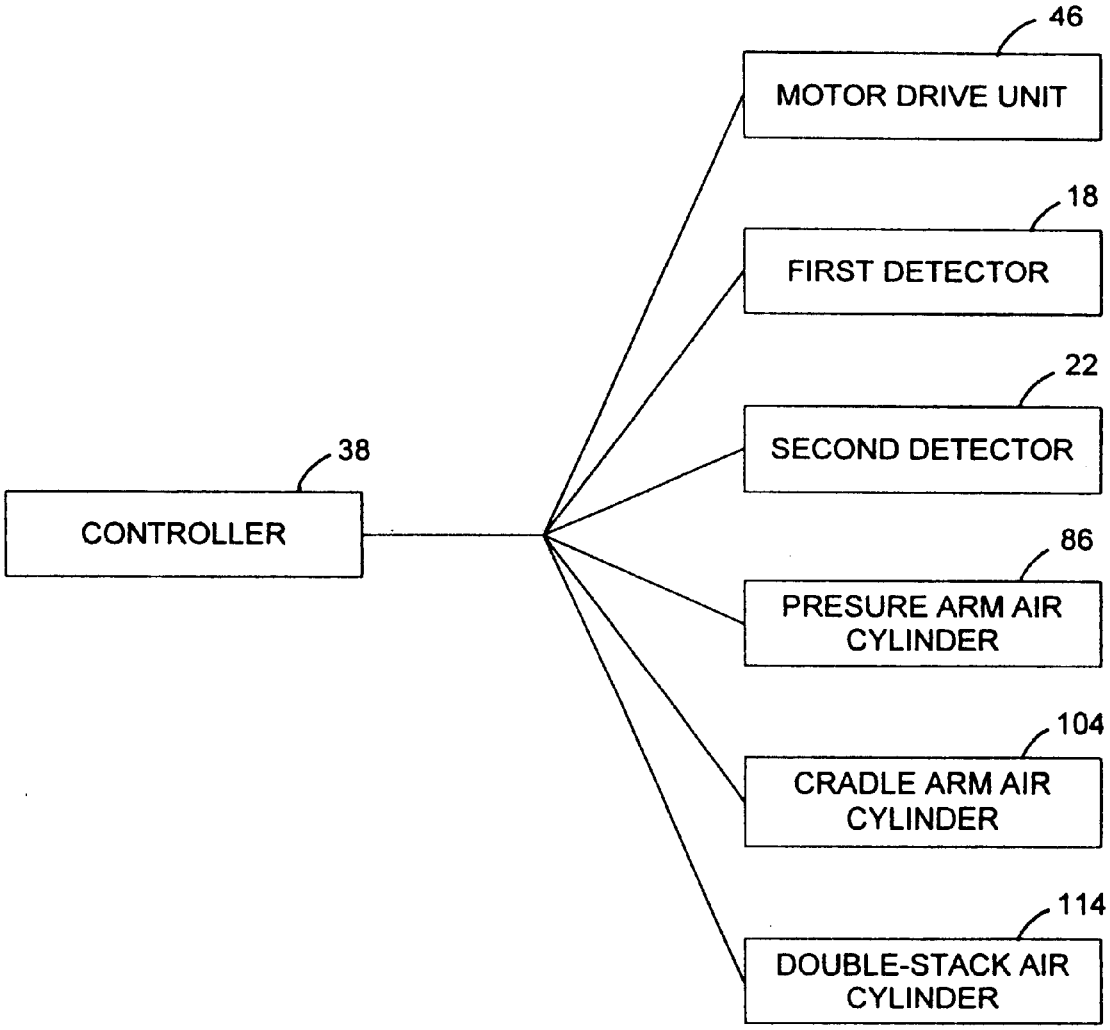
FIG. 7 is a block diagram of a microprocessor connected to various components of the rolling machine.

The controller 48 may be in the form of a microprocessor, as illustrated in FIG. 7. The detectors 18, 22 may be connected to the controller 48 to provide a signal to the controller 48 representing the detection of the leading and trailing edges 20 and 21 of the sheet material 12. The air cylinders 86, 104, 114 may likewise be controlled by the controller 48 to control the cradle arm 92, the pressure arm cradle 72, and the tucking bar 29, as well as the amount of pressure applied against the mandrel 26 by the pressure arm 74 as the sheet material 12 is rolled upon the mandrel 26. The motor drive unit 46 may also be connected to the controller 48 to control the speed of the motor drive unit 46 in response to signals detected by the detectors 18, 22.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A tucking bar for tucking sheet material between a drive roller and a mandrel of a roll-up machine comprising:

an elongated member having opposing ends; and an arm for supporting the opposing ends of the elongated member and being adapted to be pivotal about an axis that is parallel to an axis of rotation of the driver roller to move said elongated member along an arcuate path about the drive roller, said arm further including a first part that is adjustable relative to a second part.

2. The tucking bar according to claim 1 further comprising a plurality of spaced apart fingers extending from said elongated member.

3. A tucking bar for tucking sheet material between a drive roller and a mandrel of a roll-up machine comprising:

an elongated member having opposing ends;

a pair of arms for supporting said opposing ends of said elongated member, each said arm being adapted to be pivotal about an axis that is parallel to an axis of rotation of the drive roller to move said elongated member along an arcuate path about the drive roller; and a releasable fastener, said elongated member being displaceable relative to said arms in a direction transverse to said arms, said releasable fastener being adapted to releasably fasten said elongated member in a desired position relative to said arms.

4. The tucking bar according to claim 3 further comprising a plurality of spaced apart fingers extending from said elongated member.

5. A roll-up machine for rolling sheet material comprising:

a drive roller supported by a forward end of a frame, said frame being adapted to support a mandrel adjacent said drive roller;

a tucking bar also supported by a forward end of said frame for tucking sheet material between said drive roller and said mandrel;

a first detector located rearward of said drive roller for detecting the presence of sheet material; and a second detector located forward from said detector and rearward from said driver roller, said second detector being adapted to detect the presence of the sheet material.

6. The roll-up machine according to claim 5 wherein said first and second detectors are spaced a distance apart, said first and second detectors are adapted to detect a leading edge of the sheet material to determine the time it takes for the sheet material to travel the distance between said first and second detectors to further permit the rate of travel of the sheet material to be determined.

7. A roll-up machine for rolling sheet material comprising:

a drive roller supported by a forward end of a frame, said frame being adapted to support a mandrel adjacent said drive roller; and a tucking bar also supported by a forward end of said frame for tucking sheet material between said drive roller and said mandrel, said tucking bar comprising:

an elongated member having opposing ends; and an arm for supporting said opposing ends of said elongated member and being adapted to be pivotal about an axis that is parallel to an axis of rotation of said drive roller to move said elongated member along an arcuate path about said drive roller, said arm further including a first part that is adjustable relative to a second part.

8. The roll-up machine according to claim 7 further including a first detector located rearward of said drive roller for detecting the presence and absence of sheet material.

9. The roll-up machine according to claim 8 further including a second detector located forward from said first detector and rearward from said drive roller, said second detector being adapted to detect the presence and absence of sheet material.

10. The roll-up machine according to claim 7 wherein said elongated member has a plurality of spaced apart fingers extending therefrom.

11. A roll-up machine for rolling sheet material comprising:

a drive roller supported by a forward end of a frame, said frame being adapted to support a mandrel adjacent said driver roller; and a tucking bar also supported by a forward end of said frame for tucking sheet material between said drive roller and said mandrel, said tucking bar comprising:

an elongated member having opposing ends;

a pair of arms for supporting said opposing ends of said elongated member, each said arm being adapted to be pivotal about an axis that is parallel to an axis of rotation of said drive roller to move said elongated member along an arcuate path about said drive roller; and a releasable fastener, said elongated member being displaceable relative to said arms in a direction transverse to said arms, said releasable fastener being adapted to releasably fasten said elongated member in a desired position relative to said arms.

12. The roll-up machine according to claim 11 further including a first detector located rearward of said drive roller for detecting the presence and absence of sheet material.

13. The roll-up machine according to claim 12 further including a second detector located forward from said first detector and rearward from said drive roller, said second detector being adapted to detect a leading edge of the sheet material.

14. The roll-up machine according to claim 11 wherein said elongated member has a plurality of spaced apart fingers extending therefrom.

15. A roll-up machine for rolling sheet material comprising:

a drive roller supported by a forward end of a frame, said frame being adapted to support a mandrel adjacent said drive roller;

a tucking bar also supported by a forward end of said frame for tucking sheet material between said drive roller and said mandrel; and a pair of pressure arms each having a front end for supporting a corresponding end of said mandrel and a back end pivotally supported by said frame, said pressure arms being adapted to control the tightness of sheet material on said mandrel.

16. The roll-up machine according to claim 15 wherein said drive roller is a back roller, said roll-up machine further including a front roller and a guide roll located between said back roller and said front roller, said guide roll being provided for keeping the sheet material tight on said mandrel as the sheet material is tucked and started on said mandrel.

17. The roll-up machine according to claim 15 wherein at least one of said pressure arms is connected to an actuator that is adapted to maintain a pressure between said mandrel and the sheet material being rolled on said mandrel.

18. The roll-up machine according to claim 15 further including a pair of cradle arms for supporting said mandrel, each said cradle arm being pivotally supported by said frame, said cradle arm being displaceable to raise said mandrel against the force of said pressure arm.

19. A roll-up machine for rolling sheet material comprising:

a frame;

a conveyor surface supported by a back end of said frame, said conveyor surface being in the form of a perforated plate through which air is released;

a drive roller supported by a forward end of said frame, said frame being adapted to support a mandrel adjacent said drive roller;

a variable speed motor for driving said drive roller;

a tucking bar also supported by a forward end of said frame for tucking sheet material between said drive roller and said mandrel;

a pair of pressure arms each having a front end for supporting a corresponding end of said mandrel and a back end pivotally supported by said frame, said pressure arms being adapted to control the tightness of sheet material on said mandrel; and a pair of cradle arms for supporting said mandrel, each said cradle arm being pivotally supported by said frame, said cradle arms being displaceable to raise said mandrel against the force of said pressure arm.

20. The roll-up machine according to claim 19 wherein said drive roller is a back roller, said roll-up machine further including a front roller and a guide roll located between said back roller and said front roller, said guide roll being provided for keeping the sheet material tight on said mandrel as the sheet material is tucked and started on said mandrel.

21. The roll-up machine according to claim 19 further including a front roller, said drive roller being defined by a back roller, said front roller being adapted to be driven faster than said back roller.

22. The roll-up machine according to claim 19 further including one or more regulators and one or more controllers for controlling said pressure arms.

* * * * *